United States Patent [19]

Lee

[11] 3,992,499

[45] Nov. 16, 1976

[54] PROCESS FOR SHEATH-CORE COSPUN HEATHER YARNS

[75] Inventor: Lin-Fa Lee, Chattanooga, Tenn.

[73] Assignee: E. I. Du Pont de Nemours and Company, Wilmington, Del.

[22] Filed: Feb. 15, 1974

[21] Appl. No.: 442,905

[52] U.S. Cl. ..... 264/78; 8/17; 8/30; 8/100 A; 8/168 B; 8/168 C; 57/140 BY; 264/171; 428/373

[51] Int. Cl.[2] ..... D01F 1/04; B29F 3/10

[58] Field of Search ..... 264/171.78; 57/140 BY; 428/373; 8/17, 30, 100, 168 B, 168 C

[56] References Cited

UNITED STATES PATENTS 3,344,472 10/1967 Kibajima et al. ..... 264/171

*Primary Examiner*—Jay H. Woo

[57] ABSTRACT

In cospinning two fiber-forming polymers to produce a composite heather yarn from filaments of different dyeability, the apparent weight ratio of one polymer in the yarn can be varied by spinning only a portion of that polymer as a monocomponent filament and hiding the remainder as the core of a sheath-core filament having the other polymer as its sheath. Thus, a wide range of apparent weight ratios of the two polymers in the cospun yarn is provided, without changing the flow rate of the two polymer solutions fed to the spinneret.

6 Claims, 3 Drawing Figures

PROCESS FOR SHEATH-CORE COSPUN HEATHER YARNS

BACKGROUND OF THE INVENTION

Heather yarns are produced by cospinning differently dyed or dyeable filaments to provide different colors or shades in a given multifilament yarn. Spinning apparatus for such cospinning is designed to provide a given flow rate of each of the two (or more) fiber-forming spinning solutions or melts. It is often desirable to change the weight ratio of component filaments in the resultant yarn so as to provide products with a range of heather effects. With a given spinning machine, any such change from design capacities lowers the productivity of the machine. To change the machine design each time a weight-ratio change in the product is desired is prohibitively expensive.

The art needs ways and means to feed to a given spinning machine a constant flow rate of two spinning solutions and, at the same time, to adjust the spinning conditions so as to provide an apparent change in the weight ratio of these two spinning solutions in the final yarn when in fact no change has been made in the flow rate of either component.

SUMMARY OF THE INVENTION

This invention provides from a given spinning machine a wide range of apparent weight ratios of component filaments in a cospun yarn without changing the flow rate of either component to the machine. This is accomplished as follows: the component for which an apparent weight increase is desired is spun as the sheath in sheath-core filaments. The desired quantity of the other component is spun as monocomponent filaments, its excess being hidden as the core in the sheath-core filaments. A change in spinneret pack parts provides the apparent change in weight ratio of component filaments in the yarn. This concept permits production of a variety of products having different levels of dyeability and contrast without the need for extensive equipment modifications.

A primary object of the present invention is the production of yarns by a process wherein at least two different fiber-forming polymers are fed in molten form at a constant rate to a spinning apparatus and yet the apparent weight ratio of the two polymers in the resulting yarn can be apparently changed so that the viewer assumes that the proportion of one has been increased and the other decreased. Another object is the production of yarns of two differentially dyeable polymers which provide a range of dark to light mixed-color heather appearances upon being dyed, and which can be produced over an apparently wide range of filament weight ratios by cospinning two molten fiber-forming polymers of different dye affinities on a single machine to which both polymer solutions are fed at a constant rate. Another object is the provision of a novel spinneret pack assembly which makes it possible to spin multicomponent textile fibers simultaneously in a sheath-core configuration and in a homogenous composition. Other objects will become apparent from the following specification.

DESCRIPTION OF THE PRIOR ART

The plying or cospinning of groups of filaments having different dye affinities to produce dye yarns and fabrics having a mixed-color, heather appearance is known, as shown for example in U.S. Pat. No. 3,593,513 and U.S. Pat. No. 3,460,336. The latter achieves this by simultaneously crimping at least two filaments of light and dark contrasting colors or colorability and subjecting the composited structures to mechanical operations including twisting, entangling or twisting and entangling, in any order. The former discloses a process wherein two synthetic fiber-forming polymer compositions having different dye affinities are cospun into a multiplicity of filaments, the filaments are combined into a composite yarn and eventually into a fabric, to which the application of two different dyestuffs can produce a mixed-color appearance. However, when one desires to produce a blend having a different ratio of filament content on a given machine, this can only be achieved by either reducing the spinning throughput rate of one component or by modifying the polymer transport system.

Kilian U.S. Pat. No. 2,936,482 discloses a spinneret pack assembly adapted to spin sheath-core filaments in which, for example, a certain homopolymer may form the sheath and another copolymer the core. However, there is no disclosure of how this could be used to form a heather yarn from filaments of different dyeability. Related art includes U.S. Pat. Nos. 2,989,798, 3,039,174 and 3,279,163.

Japanese application No. 24688/70 also discloses differentially dyeable composite filaments, but the filaments are prepared by discontinuous spinning of one of the components. U.S. Pat. No. 3,103,732 involves cospinning of two viscoses from a common spinneret to produce bicomponent and single component filaments for crimping effects.

None of the aforesaid patents discloses a mixed filament yarn wherein the same polymer constitutes not only homofilaments but also the core of cospun sheath-/core filaments in the same yarn, along with the surprising absence of dye staining problems when the yarn is cross-dyed.

DESCRIPTION OF THE INVENTION

Figure 1:
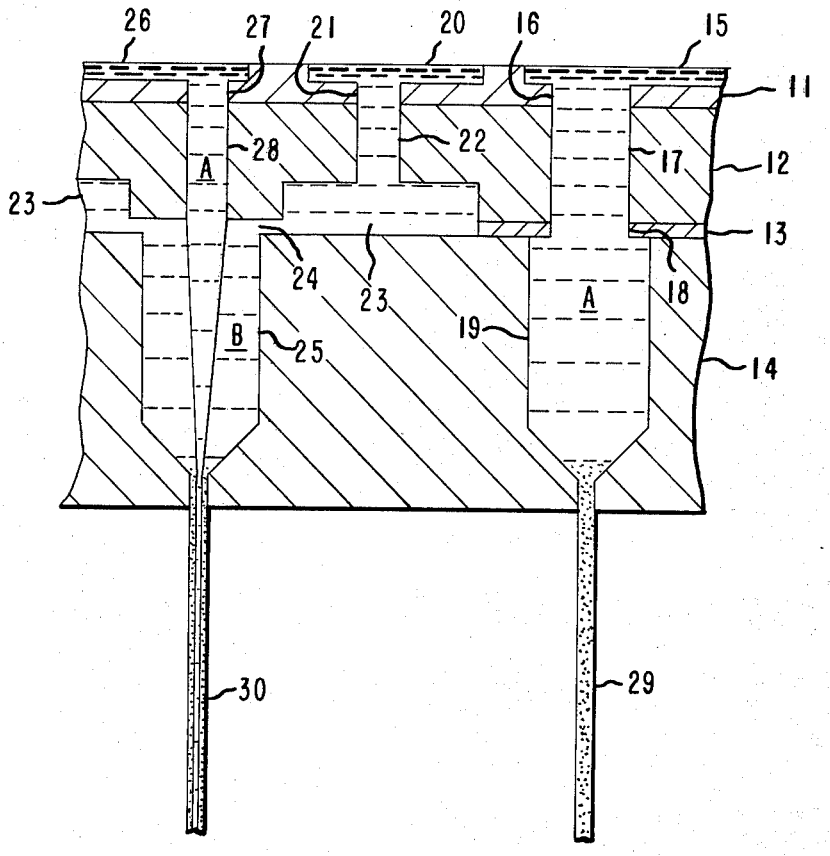
FIG. 1 illustrates in a cross-sectional schematic view a spinneret pack arrangement for cospinning the products of this invention.

The process of this invention produces cospun heather yarns by a series of steps which begin with the cospinning of sheath-core filaments and single component filaments. These comprise (1) feeding at least two molten, synthetic, thermoplastic, fiber-forming polymer compositions to a common spinning assembly, said polymer compositions having substantially different receptivities for a first class of dyes and a common receptivity for a second class of dyes, (2) spinning a portion of one composition into a first group of filaments and spinning a second group of filaments having a substantially concentric sheath-core configuration with the other polymer composition as the sheath and the remaining portion of said one composition as the core, with said core being a minor component by weight of said sheath-core filaments, (3) combining said groups of filaments into a composite yarn and (4) winding said yarn into a package.

By having "substantially different receptivities for a first class of dyes" it is meant that one of the polymers is readily dyed by a given dye while the other polymer remains substantially undyed under the same conditions, that is remains colorless or at most becomes only slightly stained to a nonobjectionable degree. By having "a common receptivity for a second class of dyes" it is meant that under a given dyeing condition both polymers become colored to a substantial degree; it is not intended that the degree of dyeing be necessarily identical, that is the same weight of dye on fiber. Preferably the "first class of dyes" are selected from the group consisting of so-called basic or cationic and acid dyes, and the "second class of dyes" are disperse dyes.

Preferably said "one polymer composition" of the first group of filaments is the polymer composition receptive to both classes of dyes, and the "other polymer composition" is the sheath polymer and is receptive to only the one class of dyes. As a result, a fabric prepared therefrom and dyed accordingly will show different colorations known as heather."

The different dye colorations may arise not only from the use of homopolymer/copolymer combinations but also from polymers of different generic classes. The polymer combinations selected for use in the invention are determined by the particular dyed and textile property effects to be achieved. In general they include the entire range of polymer combinations suggested by the prior art cited above, including combinations of poly(ethylene terephthalate) and a cationically dyeable poly(ethylene terephthalate/sulfonium salt modified ester) copolymer; poly(ethylene terephthalate) and poly(hexamethylene adipamide); poly(ethylene terephthalate) and an acid-dyeable modified polyester; an acid-dyeable polyester and a basic dyeable polyester; a polyester and a polyamide; a regular or deep-acid dyeable polyamide and a cationically dyeable polyamide such as poly(hexamethylene adipamide), or a copolymer thereof with a sodium sulfonate-salt-substituted mono- or dicarboxylic aromatic acid, e.g. 5-sodiumsulfoisophthalic acid; and a polyamide of dodecanedioic acid and bis(4-amino-cyclohexyl)methane and a differentially dyeable polyamide or polyester. Illustrative, and as a preferred embodiment, is a yarn containing filaments as described comprised of poly(ethylene terephthalate) and poly[ethylene terephthalate/5-(sodium-sulfo)isophthalate].

A surprising aspect of the invention is the absence of any staining problem from the presence of the differentially dyeable core in the sheath-core filaments. Thus the visual effects achieved upon dyeing the sheath-core filaments are substantially identical to those achieved when dyeing filaments composed 100% of the sheath polymer. To avoid complications from dye staining by the core polymer, which would reduce the heather contrast, the ratio of sheath polymer to core polymer must be so chosen that the sheath thickness is sufficient to prevent passage of an appreciable amount of the dye to which the core alone is receptive. This will depend on the size of the filaments, the polymer system, the types of dyes and the dyeing conditions. For example, for a yarn comprised of poly(ethylene terephthalate) and a copolymer of poly-[ethylene terephthalate/5-(sodium sulfo)isophthalate] as shown in Example I below, acceptable freedom from staining is achieved when the minimum sheath thickness of the sheath-core filaments averages at least about 2 microns.

The core should be substantially concentric with respect to positioning within the sheath. Preferably this means that the ratio of maximum sheath thickness to minimum sheath thickness within the filament cross-section should be less than about 3.5:1, presuming a round cross-section, and less than about 1.5:1 for fine denier filaments below 3 dpf. For nonround cross-sections the ratio should be determined with respect to a circle circumscribed within the filament to exclude any lobes and irregularities.

Another aspect of the invention is the fact that the core is also mutually dyeable with the sheath such that in a cross-dyeing situation the core does not remain undyed, which could lead to ring dyeing problems if the sheath were deeply dyed and the core undyed. Indeed, the concept was made possible by the observation that during cross-dyeing of a sheath (homopolymer)/core (copolymer) yarn, disperse dyes will dye both the sheath and core components. Basic dyes which are also present in the dye bath are incapable of reaching the core component where basic dye sites are available. The sheath which is nonbasic dyeable is therefore effectively blockading the basic dyes. In a reverse case with a basic dyeing component in the sheath, the dyeing characteristic of each component also works favorably for the intended application. The sheath will take-up both disperse dyes and basic dyes which shows up as a deep dyeing "ring" in a filament cross-section. The disperse dyes are capable of "penetrating" the basic dyeable sheath and reach the disperse dyeable core component. The core component is not left undyed which minimizes, or prevents, the potential undesirable optical or luster effects, often associated with sheath-core yarns.

The proportion of one group of filaments to the remaining proportion of the other group of filaments in the yarn is limited only by practical application. Preferred ranges are from about 10:90 to 90:10. The invention permits this entire range of filament ratios, and the associated ranges of effects, to be covered by a single mid-range polymer ratio such as 50:50.

Otherwise, for example, using a spinning position designed to yield maximum production by cospinning two polymers at a 50:50 homopolymer/copolymer ratio, the switch to a 70/30 polymer ratio would cause a 30% loss of production, not to mention the man-hours required to change the process settings to reduce polymer throughput, etc. Such additional penalties in time and manpower are avoidable by the process of this invention.

FIG. 1 illustrates the apparatus needed to cospin two polymers from a single spinneret in accordance with this invention. Essentially it requires the use of a distribution plate 11, meter plate 12, and shim 13 in combination with an existing spinneret 14. Metering of the appropriate amount of one polymer to the homofilaments and to the core of the sheath-core filaments is done by properly sizing the diameter of the sheath-core capillaries 28 and homofilament capillaries 17 in the meter plate 12. The overall pressure drop through the plates 12 and 14 should be comparable between the two types of capillaries. Shim 13 is used to provide the appropriate clearance between the meter plate 12 and spinneret plate 14 so that the sheath component can properly enter into the spinneret counterbore and form the sheath. This provides more precise control and greater flexibility than by machining the final clearance on the face of the meter plate itself. Shim plate 13 also determines which extrusion orifices (19,25) in spinneret plate 14 produce homofilaments 29 and which ones produce sheath-core filaments 30.

In operation Polymer A, for example a cationically dyeable polyester copolymer, is supplied from a source (not shown) to melt pool cavity 15 in distribution plate 11. Melt pool cavity 15 distributes the polymer to selected orifices by means of channels such as channel 16 in plate 11 aligned with orifices 17 in meter plate 12 and 18 in shim plate 13, and thus supplies the polymer to extrusion orifice 19 in spinneret plate 14 to produce a homofilament 29. Individual orifice 18 in shim plate 13 provides direct communication between 17 and 19 and thus prevents formation of a sheath-core filament.

Polymer A is also supplied to melt pool cavity 26 in distribution plate 11 (which may or may not be connected with melt pool cavity 15) from a source (not shown) which directs the polymer to channel 27 aligned with orifice 28 in meter plate 12. From a separate source (not shown) Polymer B, for example polyester homopolymer, is supplied to melt pool cavity 20 in distribution plate 11 which forwards the polymer to orifice 21 aligned with orifice 22 in meter plate 12 feeding the polymer into fluid-carrying channel means 23 in meter plate 12. Channel means 23 distributes the polymer by means of opening 24 in shim plate 13 to a plurality (not shown) of extrusion orifices such as 25 for extrusion as filament 30. Simultaneously, Polymer A from orifice 28 which is concentrically aligned with orifice 25 supplies Polymer A to the center of orifice 25 while being surrounded by Polymer B, so that both polymers are extruded as a concentric sheath-core filament 30.

The product of the invention is of high commercial interest, particularly for a heather yarn composed of 80% filaments of one type and 20% of a differentially dyeable type. This invention achieves such a product without sacrifice in productivity from a 50/50 spinning capability. Thus, a cospun 34-filament (equal denier per filament) yarn can be prepared which will give upon dyeing the effect of an "apparent" polymer composition ratio of about 80/20 (27 filaments of one component and seven filaments of the other) while having an actual polymer composition ratio of 50/50. This can be achieved by cospinning seven homofilaments of one component (A) and 27 sheath-core filaments containing 37% of polymer (A) in the core and 63% of the other polymer (B) in the sheath as shown below:

| Polymer | Parts in S-C Filaments | Parts in Homo-filaments | Total Parts in Yarn |
|---|---|---|---|
| A | 37% of 27 fil.=10 | 100% of 7 fil.=7 | 17 |
| B | 63% of 27 fil.=17 | 0% of 7 fil.=0 | 17 |

In the examples which follow, the terms "RV," "HRV," and "DFI" have these meanings:

Relative viscosity (RV) for nylon is the ratio of the viscosity of a solution of 8.4% by weight polymer in 90% formic acid/10% water by weight at 25° C. to the viscosity of the solvent.

Relative viscosity for the polyester (HRV) as used herein is the ratio of the viscosity of a solution of 0.8 gms. polymer dissolved at room temperature in 10 mls. of hexafluoroisopropanol containing 80 parts/million $H_2SO_4$ to the viscosity of the solvent itself, both measured at 25° C. in a capillary viscometer. It relates to RV as described in U.S. Pat. No. 3,593,513 by the expression:

$$HRV = RV/1.28.$$

Degree of filament intermingling (DFI) is determined as described in U.S. Pat. No. 3,593,513 on dyed yarn samples removed from the fabric and imbedded in epoxy resin.

Specific dyestuffs of the Examples are identified by their Color Index (C.I.) name or number per the American Association of Textile Chemists and Colorists.

EXAMPLE I

Figure 2:
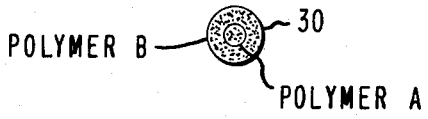
FIGS. 2 and 3 are, respectively, cross-sections of a sheath-core filament and a homogenous filament produced from the apparatus of FIG. 1.
Figure 3:
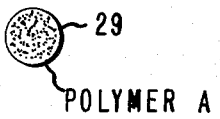

Molten poly(ethylene terephthalate) of 22 HRV and a molten copolymer of poly[ethylene terephthalate/5-(sodium sulfo)isophthalate] of 98 mole % and 2 mole % respectively, and of 14 HRV are separately metered from twin screw-melters to a melt-spinning apparatus having a spinneret pack of the type illustrated in FIG. 1, designed for spinning two yarn ends of 34 filaments each, of which 27 are of a substantially concentric sheath-core configuration and seven are single component filaments or homofilaments. The poly(ethylene terephthalate) is supplied as the sheath of the sheath-core filaments (FIG. 2). The copolymer is supplied for the homofilaments (FIG. 3) and the core of the sheath-core filaments (FIG. 2). The meter plate 12 (4.83 mm. thick) has 0.61 mm. diameter holes dimensioned and positioned to supply the homofilament capillaries; 0.71 mm. diameter holes concentrically positioned for the core polymer and 1.98 mm. diameter holes 3.36 mm. long for the sheath polymer. The distribution plate 11 directs the two polymers from their metered sources to the appropriate meter plate openings.

Using a polymer throughput ratio of 50/50 by weight 56 lbs./hr. (25.4 kg./hr.), a yarn is spun, quenched and drawn in a continuous operation. The two groups of filaments for each yarn are converged prior to drawing, drawn 3.8× their original length using a steam jet draw assist and heat-set to give a 150 denier yarn having a tenacity of 4.2 grams per denier, an elongation at break of 30% and a boil-off shrinkage of 8.9%. The yarns are treated with a lubricating finish composition suitable for texturing feed yarns and are interlaced prior to being wound into packages.

The yarns are then false-twist textured on a Leesona 553 texturing machine under conventional conditions. Two ends of the yarns, one with S and one with Z textured twist are knit into single jersey knit tubing. The knit fabric is dyed under commercial conditions. Three different cross-dyeing bath compositions, listed below, were tested.

| | |
|---|---|
| **A** | |
| 1.23%* | C.I. 51004 |
| 0.66% | C.I. Basic Red 22 |
| 0.33% | C.I. 48055 |
| 15% "Tanalon" Jet (Biphenyl nonionic carrier - Tanatex Chemical Corp.) | |
| 3.5 pH | |
| **B** | |
| 0.2% | C.I. Basic Orange 21 |
| 0.04% | C.I. 42510 |
| 0.3% | C.I. Basic Violet 24 |
| 15% Chemocarrier KD5W (Nonionic carrier for cationic dyes - Tanatex Chemical Corp.) | |
| 4.5 pH | |
| **C** | |
| 1.2% | C.I. Disperse Yellow 54 |
| 1.23% | C.I. 51004 |
| 0.66% | C.I. Basic Red 22 |

-continued

| |
|---|
| 0.33% C.I. 40055 |
| 15% "Tanalon" Jet (Biphenyl nonionic carrier) |
| 3.5 pH |

*% on weight of fabric

The dyed fabrics demonstrate good heather appearance and color contrast in both color and white and cross-dyed heathers. The effect is fully equivalent to a yarn of the same filament count containing 27 filaments of the homopolymer and seven filaments of the copolymer. The test yarn has a DFI of 85.3 (average of three determinations).

As indicated above, to utilize the 50/50 polymer ratio in 27/7 filament yarn the sheath-core filaments are composed of 63% by weight of the homopolymer in the sheath and 37% by weight of copolymer in the core. The cores are substantially concentrically located as shown by a maximum/minimum sheath thickness ratio of less than about 3.5:1. The average minimum sheath thickness is 2.7 microns based on 22 determinations with a standard deviation of 0.67.

In this and subsequent Examples the sheath thickness is determined microscopically by placing a cross-section of the yarn on a microscope slide and adding a solution of a dye to which the core only is receptive. The resulting distinct color contrast between sheath and core permits accurate measurement of the sheath thickness.

EXAMPLE II

Using the same spinning assembly, except for the required changes in spinneret pack parts to alter the ratio of sheath-core and homofilaments, and under the same conditions of polymer throughput and windup speed as Example I (no change in productivity) a yarn is spun to produce a slightly darker heather effect having a composition of 23 substantially concentric sheath-core filaments and 11 homofilaments of the copolymer to produce a 23/11 filament ratio heather effect from the same 50/50 polymer ratio. Because of the change in filament ratio while keeping the same 50/50 polymer ratio the sheath-core filaments are composed of 73.8% by weight of the homopolymer in the sheath and 26.2% by weight of copolymer in the core. The average minimum sheath thickness is 3.9 microns based on 20 determinations with standard deviation of 0.76.

The yarn is spun, drawn, set, interlaced and packaged essentially as above using a draw ratio of 3.8× to provide a total denier of 150, a tenacity of 4.0 gpd., a break elongation of 36% and a boil-off shrinkage of 8.3%. Knit fabrics of textured yarn prepared as described above and dyed, provide a pleasing heather effect (DFI 94.2, average of three measurements) and color contrast fully equivalent to a yarn composed of 23 homopolymer filaments and 11 copolymer filaments.

EXAMPLE III

Using the cospinning technique of Example I, a composite yarn is prepared from poly(hexamethylene adipamide) of 41 RV and poly(ethylene terephthalate) of 22 HRV of 145 total denier and containing 23 substantially concentric sheath-core filaments with poly(ethylene terephthalate) in the sheath and the polyamide in the core and 11 homofilaments of the poly(hexamethylene adipamide). The polymers are spun in a 54/46 ratio by weight of polyester to polyamide such that the sheath-core filaments are composed of 82.2% by weight polyester and 17.8% by weight polyamide.

The 145 denier 34-filament yarn has a tenacity of 4.9 gpd., an elongation of 40.2% and a shrinkage of 7.5%. The average minimum sheath thickness is 4.7 microns based on 34 determinations with a standard deviation of 0.68. The yarn is false-twist textured and knitted into fabric, and the fabric samples cross-dyed using two different dye recipes as shown in the following Table.

| D |
|---|
| 2.2% C.I. ABL107 |
| 9.0 pH |
| 1 hour at boil |
| **E** |
| 0.8% C.I. Disperse Yellow 54 |
| 2.2% C.I. ABL107 |
| 15% Charlab W-5 (Biphenyl nonionic carrier from Charlotte Chem. Laboratories, Inc.) |
| 2 hours at boil |

The dyed fabrics demonstrate good heather appearance and color contrast representative of the filament ratio rather than the overall yarn polymer ratio.

What is claimed is:

1. In a process for the manufacture of a cospun heather yarn which comprises feeding at least two molten, synthetic, thermoplastic, fiber-forming polymer compositions selected from the group consisting of polyamides and polyesters to a common spinning assembly, said polymer compositions having substantially different receptivities for a first class of dyes and a common receptivity for a second class of dyes, the improvement by which the weight ratio of the two polymer compositions in the yarn is apparently changed which comprises spinning a portion of one composition into a first group of filaments and spinning the remainder of that composition into the core of a second group of cospun filaments having a substantially concentric sheath-core structure, with the other polymer composition as the sheath, the core being a minor component by weight of said sheath-core filament, and combining said groups of filaments into a composite yarn.

2. The process of claim 1 wherein one composition is a polyester and the other is a copolyester.

3. The process of claim 1 wherein one composition is molten poly(ethylene terephthalate) and the other composition is a molten copolymer of poly(ethylene terephthalate) and 5-(sodium-sulfo)isophthalate.

4. The process of claim 1 wherein the fiber-forming polymer compositions are fed at a fixed constant rate to the spinning assembly, but the apparent weight ratio of each in the composite yarn is varied by concealing a portion of one composition in the filamentary core of the other composition.

5. Process of claim 4 wherein the two polymer compositions are fed to the spinning assembly at a constant 50/50 weight ratio, but the apparent weight ratio of one to the other in the composite yarn is varied from about 10:90 to 90:10.

6. Process of claim 1 wherein the composite yarn is cross-dyed so as to apply different colorations to the two types of filaments.

* * * * *